US012570432B2

(12) United States Patent
Royal

(10) Patent No.: US 12,570,432 B2
(45) **Date of Patent: *Mar. 10, 2026**

(54) BOTTLE PACKAGING ASSEMBLY

(71) Applicant: Pratt Corrugated Holdings, Inc., Brookhaven, GA (US)

(72) Inventor: Austin Thomas Royal, Snellville, GA (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/798,897

(22) Filed: Aug. 9, 2024

(65) Prior Publication Data

US 2024/0400254 A1 Dec. 5, 2024

Related U.S. Application Data

(60) Division of application No. 18/209,910, filed on Jun. 14, 2023, now Pat. No. 12,091,225, which is a (Continued)

(51) Int. Cl.
*B65D 5/50* (2006.01)
*B65D 5/497* (2006.01)
(Continued)

(52) U.S. Cl.
CPC ..... *B65D 5/48044* (2013.01); *B65D 81/05* (2013.01); *B65D 85/30* (2013.01); *B65D 2581/051* (2013.01)

(58) Field of Classification Search
CPC ..... B65D 71/24; B65D 71/243; B65D 71/06; B65D 71/00; B65D 81/0205; B65D 2581/051; B65D 85/30; B65D 5/48044
(Continued)

(56) References Cited

U.S. PATENT DOCUMENTS 3,438,482 A 4/1969 Hamilton
3,495,704 A 2/1970 Richards et al.
(Continued)

FOREIGN PATENT DOCUMENTS

FR 2738228 3/1997
FR 3082188 12/2019
(Continued)

OTHER PUBLICATIONS

Global Sources; Article entitled: "Custom logo, sturdy, brown corrugated paper, 6 bottles, 12 bottles, shipping carton box for red wine", available at <https://www.globalsources.com/Wine-box/red-wine-carton-1171712214p.htm#1171712214>, accessed on Sep. 11, 2020, 5 pgs.

(Continued)

*Primary Examiner* — King M Chu
(74) *Attorney, Agent, or Firm* — Taylor Duma LLP

(57) ABSTRACT

A bottle packaging assembly includes a bottle packaging comprising a sidewall enclosure, the sidewall enclosure defining an interior cavity and comprising a first sidewall and a second sidewall opposite the first sidewall; a plurality of bottle insert assemblies arranged laterally side-by-side within the interior cavity, wherein each of the bottle insert assemblies comprises: a first bottle insert arranged proximate to the first sidewall and defining a first bottle opening configured to receive a first portion of a bottle; and a second bottle insert arranged proximate to the second sidewall and longitudinally aligned with the first bottle insert, the second bottle insert defining a second bottle opening configured to receive a second portion of the bottle.

15 Claims, 8 Drawing Sheets

Related U.S. Application Data continuation of application No. 17/511,814, filed on Oct. 27, 2021, now Pat. No. 11,713,155.

(60) Provisional application No. 63/111,417, filed on Nov. 9, 2020.

(51) Int. Cl.
*B65D 81/05* (2006.01)
*B65D 85/30* (2006.01)

(58) Field of Classification Search
USPC ..... 206/427, 196
See application file for complete search history.

(56) References Cited

U.S. PATENT DOCUMENTS

| | | | | |
|---|---|---|---|---|
| 5,341,934 | A | 8/1994 | Hsu | |
| 5,358,101 | A | 10/1994 | Lombardi | |
| 5,772,025 | A | 6/1998 | Chen et al. | |
| 6,702,115 | B1 | 3/2004 | Roper | |
| 8,230,997 | B1 | 7/2012 | Mcwilliams et al. | |
| 8,434,620 | B2 * | 5/2013 | Hall | B65B 5/08 220/532 |
| D881,718 | S | 4/2020 | Bandinu | |
| 11,713,155 | B2 * | 8/2023 | Royal | B65D 77/0426 206/427 |
| 12,091,225 | B2 | 9/2024 | Royal | |
| 2022/0144480 | A1 | 5/2022 | Royal | |
| 2023/0322434 | A1 | 10/2023 | Royal | |

FOREIGN PATENT DOCUMENTS

| | | |
|---|---|---|
| JP | 6684501 | 4/2020 |
| WO | 2015049702 | 4/2015 |
| WO | 2017059848 | 4/2017 |

OTHER PUBLICATIONS

NAKPACK; Article entitled: "The Safety of your Shipments Starts with the Packaging", available at <http://www.nakpack.co.uk/how-it-works.php>, Copyright 2017, accessed on Sep. 11, 2020, 7 pgs.
Royal, Austin Thomas; Non-Final Office Action for U.S. Appl. No. 17/511,814, filed Oct. 27, 2021, mailed Nov. 23, 2022, 12 pgs.
Royal, Austin Thomas; Notice of Allowance for U.S. Appl. No. 17/511,814, filed Oct. 27, 2021, mailed Mar. 16, 2023, 7 pgs.
Salazar Packaging; Article entitled: "NEW: Attractive, Custom Printable, Eco-Friendly Packaging for Shipping Wine Bottles", available at <https://www.salazarpackaging.com/new-attractive-custom-printable-eco-friendly-packaging-for-shipping-wine-bottles/>, published Jun. 20, 2019, accessed on Sep. 11, 2020, 4 pgs.
Royal, Austin Thomas; Applicant-Initiated Interview Summary for U.S. Appl. No. 18/209,910, filed Jun. 14, 2023, mailed Apr. 18, 2024, 2 pgs.
Royal, Austin Thomas; Non-Final Office Action for U.S. Appl. No. 18/209,910, filed Jun. 14, 2023, mailed Feb. 12, 2024, 16 pgs.
Royal, Austin Thomas; Notice of Allowance for U.S. Appl. No. 18/209,910, filed Jun. 14, 2023, mailed Jul. 17, 2024, 8 pgs.
Royal, Austin Thomas; Requirement for Restriction/Election for U.S. Appl. No. 18/209,910, filed Jun. 14, 2023, mailed Jan. 17, 2024, 6 pgs.

* cited by examiner

BOTTLE PACKAGING ASSEMBLY

CROSS-REFERENCE TO RELATED APPLICATIONS

The present application is a divisional of U.S. application Ser. No. 18/209,910, filed Jun. 14, 2023, which is a continuation of U.S. application Ser. No. 17/511,814, filed Oct. 27, 2021, which issued as U.S. Pat. No. 11,713,155 on Aug. 1, 2023, and which claims the benefit of U.S. Application No. 63/111,417, filed Nov. 9, 2020, each of which is hereby specifically incorporated by reference herein in its entirety.

TECHNICAL FIELD

This disclosure relates to packaging. More specifically, this disclosure relates to a bottle insert assembly for bottle packaging.

BACKGROUND

Bottles, such as wine bottles, beer bottles, liquor bottles, water bottles, etc., can be transported in packaging from one place to another. However, bottles not sufficiently restrained within the packaging can move within the packaging, which can result in damage to the bottles and/or the packing. Additionally, the packaging can be bumped or jarred during transportation, which can result in damage to the bottles therein. The packing can also be compressed, crushed, or otherwise damaged during transportation, which can result in the packing providing insufficient support or cushioning to the bottles therein.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a bottle insert assembly comprising an upper bottle insert comprising an upper insert body and an upper insert partition, the upper insert body defining an upper bottle opening therethrough; and a lower bottle insert comprising a lower insert body and a lower insert partition, the lower insert body defining a lower bottle opening therethrough.

Also disclosed is a bottle insert comprising an insert body defining a bottle opening, the bottle opening configured to receive a portion of a bottle therethrough; and an insert partition disposed substantially within the insert body, the insert partition defining a partition wall, the partition wall aligned with and spaced from the bottle opening, the partition wall configured to confront an end of the bottle.

Additionally, disclosed is a bottle insert assembly comprising a first bottle insert comprising a first insert body and a first insert partition disposed substantially within the first insert body, the first insert body defining a first bottle opening, the first bottle opening configured to receive a first portion of a bottle therethrough, the first insert partition configured to confront a first end of the bottle; and a second bottle insert comprising a second insert body and a second insert partition disposed substantially within the second insert body, the second insert body defining a second bottle opening, the second bottle opening configured to receive a second portion of a bottle therethrough, the second insert partition configured to confront a second end of the bottle.

A bottle packaging assembly is disclosed, the bottle packaging assembly comprising a bottle packaging comprising a sidewall enclosure, the sidewall enclosure defining an interior cavity and comprising a first sidewall and a second sidewall opposite the first sidewall; a plurality of bottle insert assemblies arranged laterally side-by-side within the interior cavity, wherein each of the bottle insert assemblies comprises: a first bottle insert arranged proximate to the first sidewall and defining a first bottle opening configured to receive a first portion of a bottle; and a second bottle insert arranged proximate to the second sidewall and longitudinally aligned with the first bottle insert, the second bottle insert defining a second bottle opening configured to receive a second portion of the bottle.

Further, disclosed is a method of packaging a bottle comprising providing a bottle packaging assembly comprising a first bottle insert defining a first bottle opening and a second bottle insert defining a second bottle opening, wherein the first bottle insert and the second bottle insert are arranged within an interior cavity of a bottle packaging; receiving a second portion of the bottle through the second bottle opening; and receiving a first portion of the bottle through the first bottle opening.

Also disclosed is a method of assembling a bottle packaging assembly comprising folding a first bottle insert to an assembled configuration, the first bottle insert comprising a first base panel, the first base panel defining a first bottle opening configured to receive a first portion of a bottle; folding a second bottle insert to an assembled configuration, the second bottle insert comprising a second base panel, the second base panel defining a second bottle opening configured to receive a second portion of a bottle; arranging the first bottle insert proximate to a first sidewall of a sidewall enclosure of a bottle packaging; and arranging the second bottle insert proximate to a second sidewall of the sidewall enclosure, wherein the second sidewall is opposite the first sidewall, and wherein the second bottle insert is longitudinally aligned with the first bottle insert Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
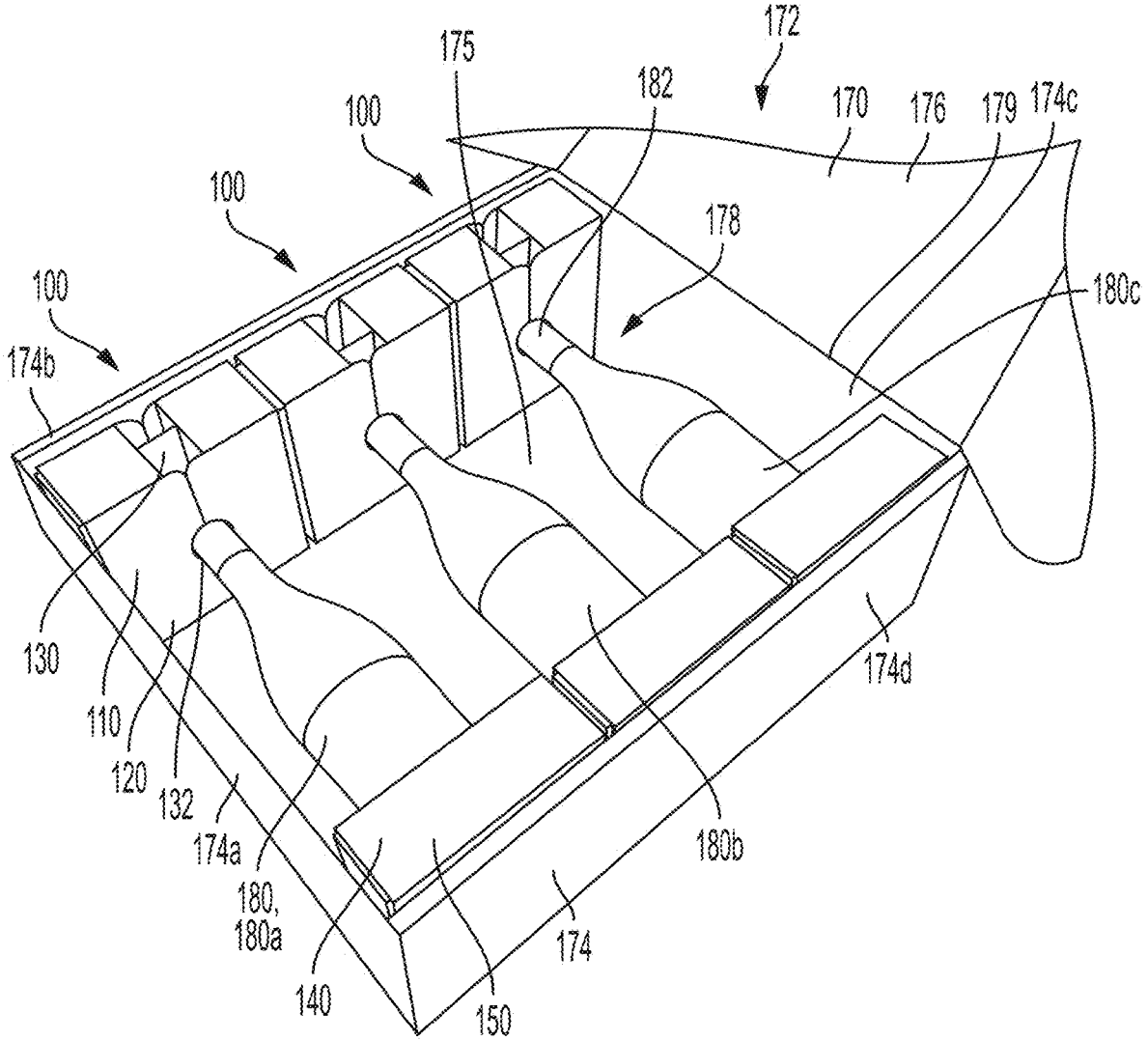
FIG. 1 is a top perspective view of a plurality of bottle insert assemblies assembled with a bottle packaging, in accordance with one aspect of the present disclosure, wherein each of the bottle insert assemblies comprise an upper bottle and a lower bottle insert.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a bottle insert assembly and associated methods, systems, devices, and various apparatus. Example aspects of the bottle insert assembly can comprise an upper bottle insert configured to retrain an upper portion of a bottle and a lower bottle insert configured to restrain a lower portion of the bottle. It would be understood by one of skill in the art that the bottle insert assembly is described in but a few exemplary embodiments among many. No particular terminology or description should be considered limiting on the disclosure or the scope of any claims issuing therefrom.

FIG. 1 is a top perspective view of a plurality of bottle insert assemblies 100 assembled with a bottle packaging 170, in accordance with one aspect of the present disclosure.

In the present aspect, the bottle packaging 170 can be a box 172 comprising a sidewall enclosure 174, a bottom wall 175, and a lid 176. Example aspects of the sidewall enclosure 174 can comprise first, second, third, and fourth sidewalls 174*a-d*, as shown, though other aspects can comprise more or fewer sidewalls. The sidewall enclosure 174 and bottom wall 175 can define an interior cavity 178 of the box 172. The lid 176 can be hingedly coupled to the sidewall enclosure 174 to selectively cover and uncover an opening 179 allowing access to the box 172. The box 172 can be configured to house one or more bottles 180 within the interior cavity 178; for example, in the present aspect, the box 172 can be configured to house three wine bottles 180*a-c*. In other aspects, the box 172 can be configured to house more or fewer bottles 180, and the bottles 180 can be any suitable type of bottle known in the art, including, but not limited, beer bottles, liquor bottles, soda bottles, water bottles, and the like.

As shown, each of the bottle insert assemblies 100 can be configured to restrain a corresponding one of the bottles 180 within the interior cavity 178. According to example aspects, each bottle insert assembly 100 can comprise an upper bottle insert 110 configured to restrain an upper portion 182 of the bottle 180 and a lower bottle insert 140 configured to restrain a lower portion 1284 (shown in FIG. 12) of the bottle 180. According to example aspects, each bottle insert assembly 100 can be configured to space the corresponding bottle 180 a minimum distance from each of the sidewalls 174*a-d*, bottom wall 175, and lid 176. For example, in the present aspect, each bottle insert assembly 100 can be configured to space the corresponding bottle 180 a minimum distance of ¾" from each of the sidewalls 174*a-d*, bottom wall 175, and lid 176. In other aspects, the minimum distance can be lesser or greater than ¾". In example aspects, each upper bottle insert 110 can comprise an upper insert body 120 and an upper insert partition 130 generally received within the upper insert body 120. Similarly, each lower bottle insert 140 can comprise a lower insert body 150 and a lower insert partition 1160 (shown in FIG. 11) generally received within the lower insert body 150. In some aspects, an upper end (not shown) of the corresponding bottle 180 can abut the upper insert partition 130 and a lower end (not shown) of the bottle 180 can abut the lower insert partition 1160 to substantially prevent or limit longitudinal movement of the bottle 180 within the interior cavity 178. Furthermore, the upper portion 182 of the bottle 180 can be received through an upper bottle opening 132 of the upper insert body 120, and the lower portion 1284 of the bottle 180 can be received through a lower bottle opening 1062 (shown in FIG. 10) of the lower insert body 150. Each of the upper bottle opening 132 and lower bottle opening 1062 can be sized to substantially prevent or limit lateral and/or rotational movement of the bottle 180 within the interior cavity 178.

Figure 2:
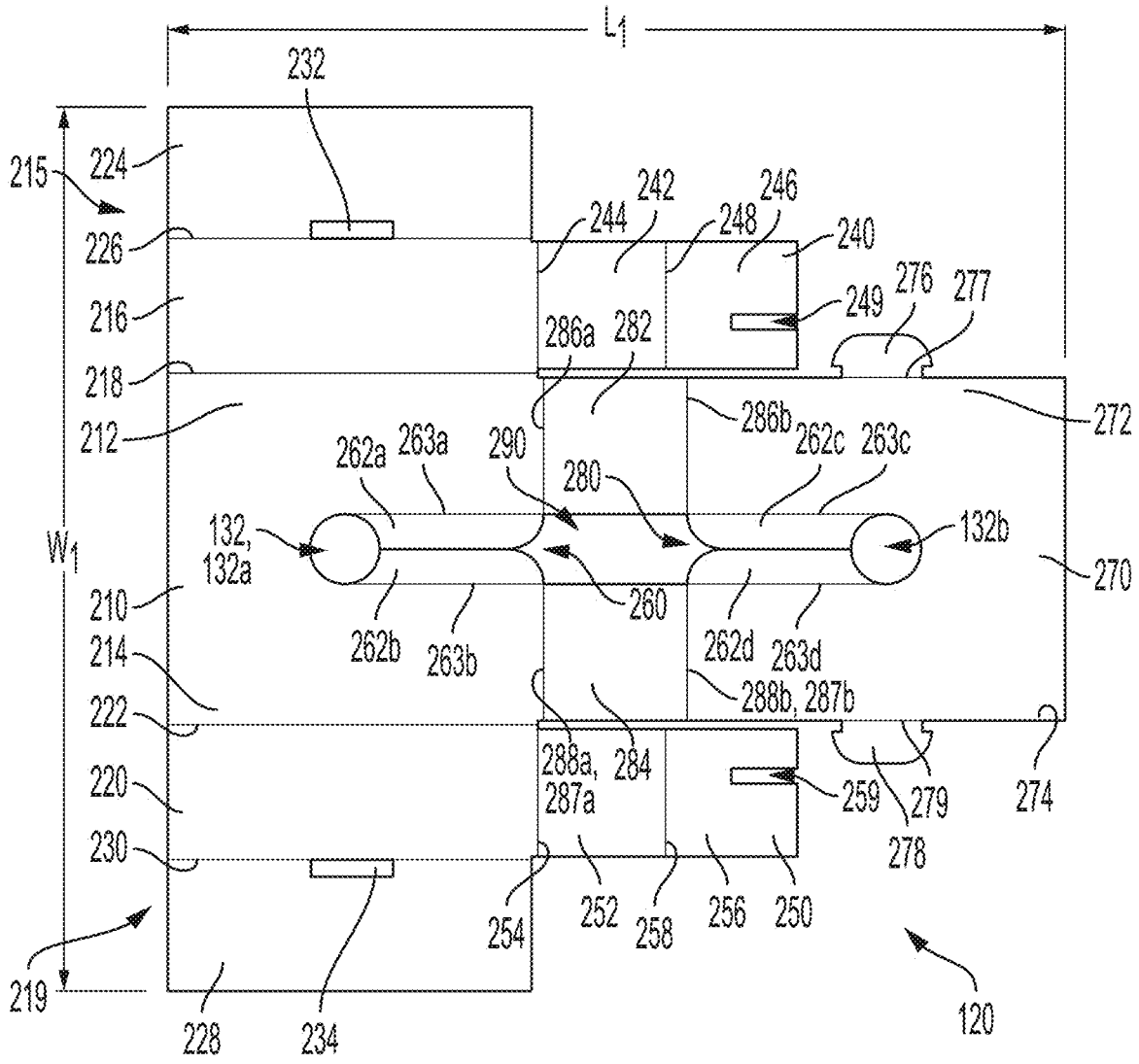
FIG. 2 is a top plan view of an upper insert body of one of the upper insert assemblies of FIG. 1, wherein the upper insert body is in blank form.

FIG. 2 illustrates the upper insert body 120 of the upper bottle insert 110 (shown in FIG. 1) in blank form, according to an example aspect of the present disclosure. In blank form, the upper bottle insert 110 can define an overall width $W_1$ and an overall length $L_1$. In a particular example aspect, the width $W_1$ can be about 13.5" and the length $L_1$ can be about 13.6875". In other aspects, the upper insert body 120 can define any other suitable dimensions. As shown, the upper insert body 120 can define a lower base panel 210 and an upper base panel 270. The upper base panel 270 and lower base panel 210 can be connected by a first connecting panel 282 and a second connecting panel 284. In example aspects, the first connecting panel 282 can be hingedly connected to the lower base panel 210 by a first connecting bend line 286*a* and to the upper base panel 270 by a first connecting bend line 286*b*. Similarly, the second connecting panel 284 can be hingedly connected to the lower base panel 210 by a second connecting bend line 288*a* and to the upper base panel 270 by a second connecting bend line 288*b*. Thus, as shown, the first and second connecting bend lines 286*a*, 288*a* can be formed at an inner panel edge 287*a* of the lower base panel 210, and similarly, the first and second connecting bend lines 286*b*,288*b* can be formed at an inner panel edge 287*b* of the upper base panel 270. A gap 290 can be defined between the first and second connecting panels 282,284, as shown.

The lower base panel 210 can define a first side 212 and an opposite second side 214. A first side panel assembly 215 can extend from the first side 212, and a second side panel assembly 219 can extend from the second side 214. The first side panel assembly 215 can comprise a first intermediate panel 216 that can be hingedly connected to the first side 214 of the lower base panel 210 at a first intermediate bend line 218. The second side panel assembly 219 can comprise a second intermediate panel 220 that can be hingedly connected to the second side 214 of the lower base panel 210 at a second intermediate bend line 222. The first side panel assembly 215 can further comprise a first outer panel 224 that can be hingedly connected to the first intermediate panel 216 distal to the lower base panel 210 at a first outer bend line 226. Similarly, the second side panel assembly 219 can further comprise a second outer panel 228 that can be hingedly connected to the second intermediate panel 220 distal to the lower base panel 210 at a second outer bend line 230. According to example aspects, the first side panel assembly 215 can define a first locking slot 232 at or near the first outer bend line 226. In the present aspect, the first locking slot 232 can be defined through the first outer panel 224 at the first outer bend line 226. The second side panel assembly 219 can define a second locking slot 234 at or near the second outer bend line 230. In the present aspect, the second locking slot 234 can be defined through the outer panel 228 at the second outer bend line 230. Each of the first and second locking slots 232,234 can be oriented substantially centrally along a length of the corresponding first and second outer bend lines 226,230.

According to example aspects, a first auxiliary flap 240 can extend from the first intermediate panel 216 between the lower base panel 210 and the first outer panel 224. The first auxiliary flap 240 can extend generally in the direction of the upper base panel 270. Furthermore, the first auxiliary flap 240 can define a first auxiliary section 242 hingedly connected to the first intermediate panel 216 by a first auxiliary bend line 244 and a second auxiliary section 246 hingedly connected to the first auxiliary section 242 distal to the first intermediate panel 216 by a second auxiliary bend line 248. A first auxiliary slot 249 can extend into the second auxiliary section 246 distal to the first auxiliary section 242, as shown. Moreover, a second auxiliary flap 250 can extend from the second intermediate panel 220 between the lower base panel 210 and the second outer panel 228, which can be substantially similar to the first auxiliary flap 240. The second auxiliary flap 250 can extend generally in the direction of the upper base panel 270. The second auxiliary flap 250 can define a third auxiliary section 252 hingedly connected to the second intermediate panel 220 by a third auxiliary bend line 254 and a fourth auxiliary section 256 hingedly connected to the third auxiliary section 252 distal to the second intermediate panel 220 by a fourth auxiliary bend line 258.

A second auxiliary slot 259 can extend into the fourth auxiliary section 256 distal to the second auxiliary section 246, as shown.

The upper bottle insert 110 can define one or more of the upper bottle openings 132. In the present aspect, the lower base panel 210 can define a first one of the upper bottle openings 132 formed substantially through a center thereof. The lower base panel 210 can further define a first bottle channel 260 extending from a first upper bottle opening 132*a* to the inner panel edge 287*a* and the corresponding gap 290 defined between the first and second connecting panels 282,284. In example aspects, first and second channel tabs 262*a,b* can be hingedly connected to and extend from the lower base panel 210 into the first bottle channel 260 at first and second channel bend lines 263*a,b*, respectively. Each of the first and second channel tabs 262*a,b* can extend from the first upper bottle opening 132*a* to the inner panel edge 287*a* and the gap 290. In the present configuration, the first and second channel tabs 262*a,b* can substantially cover the first bottle channel 260, as shown. According to example aspects, the upper portion 182 (shown in FIG. 1) of a corresponding one of the bottles 180 (shown in FIG. 1) can engage the first upper bottle opening 132*a* either by inserting the upper portion 182 directly through the first upper bottle opening 132*a* or by sliding the upper portion 182 through the first bottle channel 260 and into the first upper bottle opening 132*a*. The first and second channel tabs 262*a,b* can be folded away from the first bottle channel 260 relative to the lower base panel 210 at the corresponding first and second channel bend lines 263*a,b* to allow access through the first bottle channel 260. The upper portion 182 of the bottle 180 can be removed from the first upper bottle opening 132*a* by the same method.

According to example aspects, the upper base panel 270 can be substantially similar to the lower base panel 210. For example, the upper base panel 270 can comprise a second one of the upper bottle openings 132*b* formed substantially through a center thereof. The upper base panel 270 can further define a second bottle channel 280 extending from the second upper bottle opening 132*b* to the inner panel edge 287*b* and the corresponding gap 290. Third and fourth channel tabs 262*c, d* can be hingedly connected to and extend from the upper base panel 270 into the second bottle channel 280 at third and fourth channel bend lines 263*c,d*, respectively. Each of the third and fourth channel tabs 262*c,d* can extend from the second upper bottle opening 132*b* to the inner panel edge 287*b* and the gap 290. Furthermore, as shown, the upper base panel 270 can define a first side 272 and an opposite second side 274. In example aspects, a first locking tab 276 can be hingedly connected to and extend from the first side 272 of the upper base panel 270 at a first tab bend line 277 and a second locking tab 278 can be hingedly connected to and extend from the second side 274 of the upper base panel 270 at a second tab bend line 279.

Figure 3:
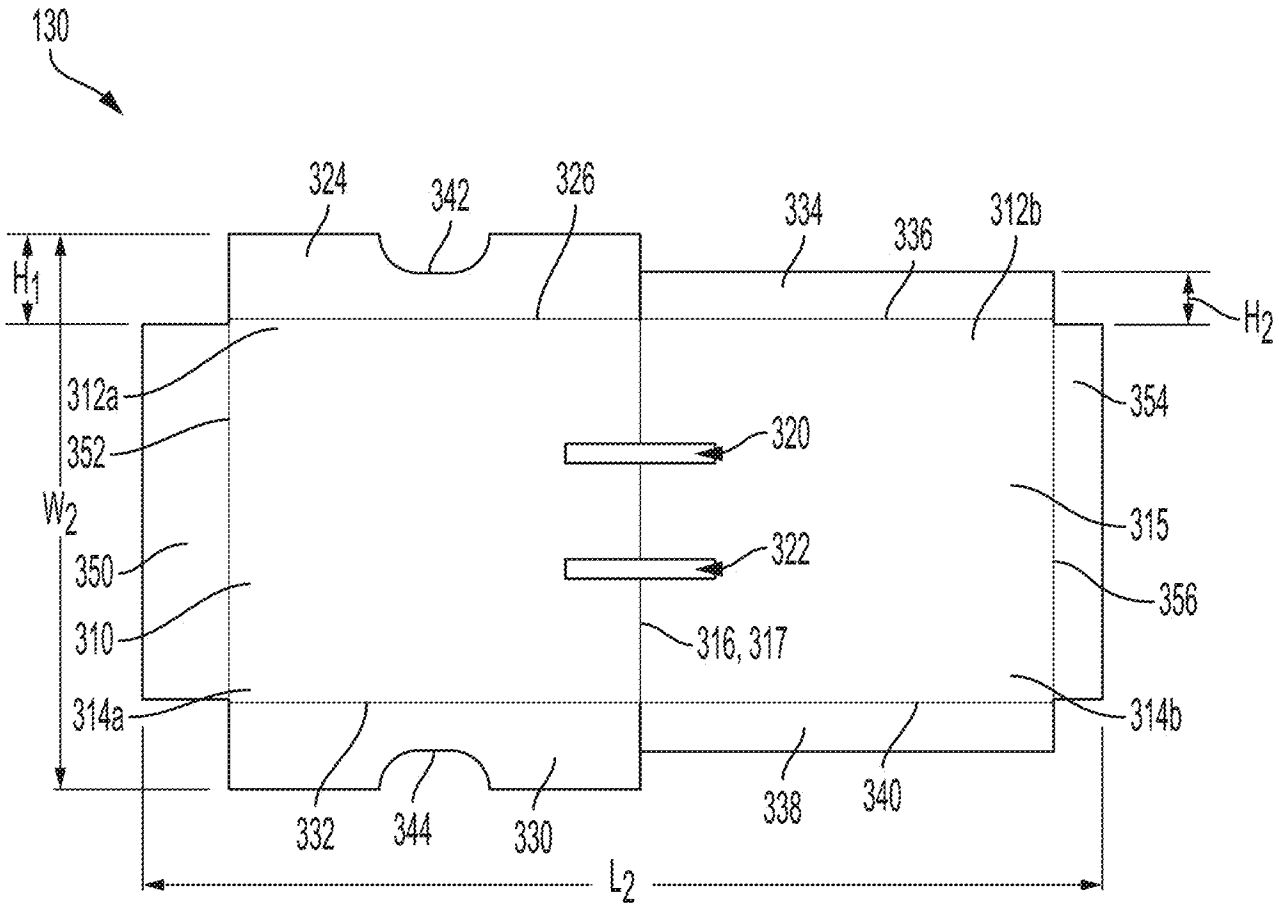
FIG. 3 is a top plan view of an upper insert partition of one of the upper insert assemblies of FIG. 1, wherein the upper insert partition is in blank form.

FIG. 3 illustrates the upper insert partition 130 of the upper bottle insert 110 (shown in FIG. 1) in blank form, according to an example aspect of the present disclosure. In blank form, the upper insert partition 130 can define an overall width $W_2$ and an overall length $L_2$. In a particular example, aspect, the width $W_2$ can be about 6.5625" and the length $L_2$ can be about 12.625". In other aspects, the upper insert partition 130 can define any other suitable dimensions. According to example aspects, the upper insert partition 130 can define a first partition wall 310 and a second partition wall 315 hingedly connected to the first partition wall 310 at a partition wall bend line 316. The partition wall bend line 316 can define an inner partition edge 317 of each of the first and second partition walls 310,315. A first partition slot 320 and a second partition slot 322 can each extend across and be oriented perpendicular to the partition wall bend line 316, as shown. Each of the first partition wall 310 and second partition wall 315 can define a first side 312*a,b*, and a second side 314*a,b*, respectively. A first large spacer flap 324 can be hingedly connected to and can extend from the first side 312*a* of the first partition wall 310 at a first large spacer bend line 326, and a first small spacer flap 334 can be hingedly connected to and can extend from the first side 312*b* of the second partition wall 315 at a first small spacer bend line 336. The first large spacer flap 324 can be oriented adjacent to the first small spacer flap 334. Similarly, a second large spacer flap 330 can be hingedly connected to and can extend from the second side 314*a* of the first partition wall 310 at second large spacer bend line 332, and a second small spacer flap 338 can be hingedly connected to and can extend from the second side 314*b* of the second partition wall 315 at a second small spacer bend line 340. Each of the first and second large spacer flaps 324,330 can define a height $H_1$ that can be greater than a height $H_2$ of each of the first and second small spacer flaps 334,338. In some aspects, the first large spacer flap 324 and the second large spacer flap 330 can define a first locking cut-out 342 and a second locking cut-out 344, respectively, distal to the corresponding first and second large spacer bend lines 326,332, respectively. Furthermore, a first end flap 350 can be hingedly connected to and can extend from the first partition wall 310 distal to the second partition wall 315 at a first end bend line 352, and a second end flap 354 can be hingedly connected to and can extend from the second partition wall 315 distal to the first partition wall 310 at a second end bend line 356.

Figure 4:
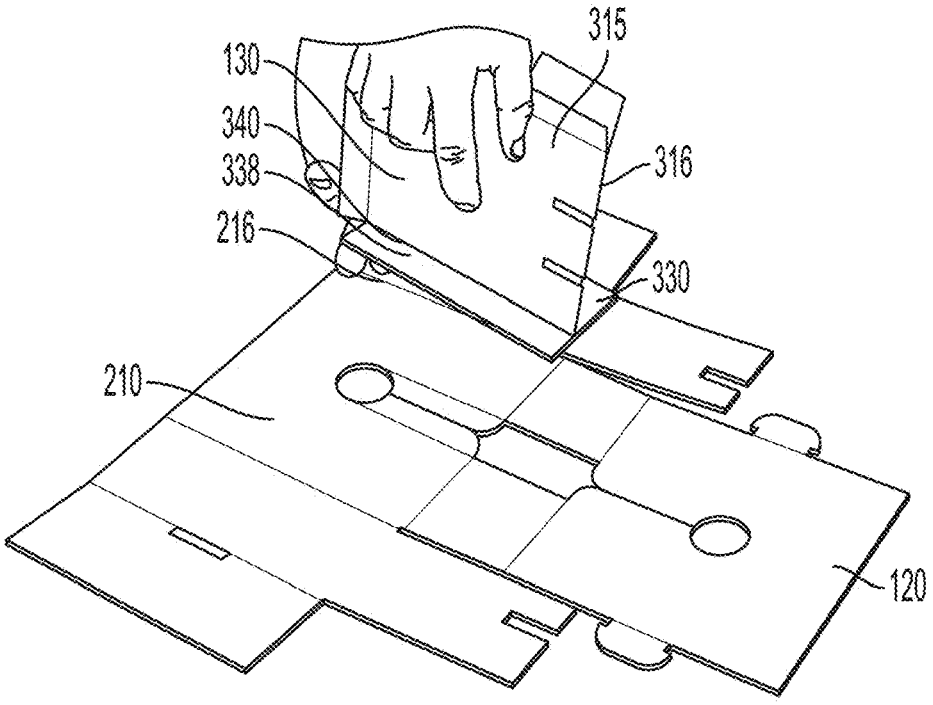
FIG. 4 is a top perspective view of a first step in assembling the upper insert partition of FIG. 3 with the upper insert body of FIG. 2.

FIGS. 4-9 illustrate a method of the assembling the upper insert partition 130 with the upper insert body 120 to define the upper bottle insert 110 shown in FIG. 1. Referring to FIG. 4, according to example aspects, the first partition wall 310 (shown in FIG. 3) of the upper insert partition 130 can be folded towards the second partition wall 315 at the partition wall bend line 316. The second large spacer flap 330 and second small spacer flap 338 can be folded away from one another at the second large spacer bend line 332 (shown in FIG. 3) and the second small spacer bend line 340, respectively, such that the second large spacer flap 330 and second small spacer flap 338 can be oriented about perpendicular to the first partition wall 310 and second partition wall 315 and about parallel with one another. The second large spacer flap 330 and second small spacer flap 338 can engage and lie substantially flat against the first intermediate panel 216 of the upper insert body 120.

Figure 5:
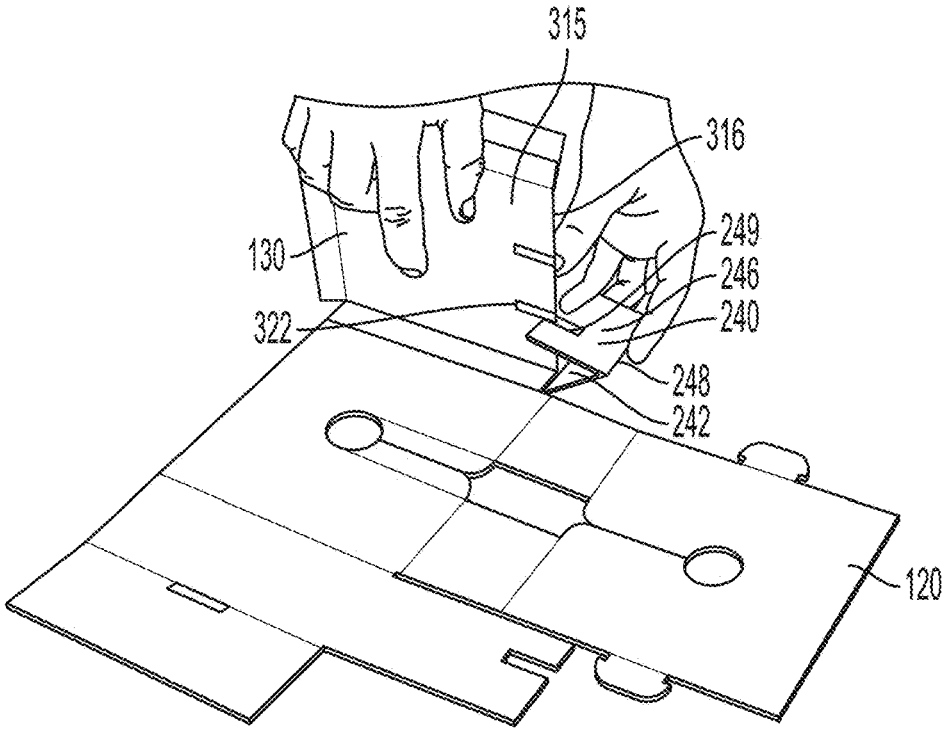
FIG. 5 is a top perspective view of a second step in assembling the upper insert partition of FIG. 3 with the upper insert body of FIG. 2.

Referring to FIG. 5, the first auxiliary flap 240 can be folded towards the upper insert partition 130 at each of the first auxiliary bend line 244 (shown in FIG. 2) and the second auxiliary bend line 248. The first auxiliary slot 249 of the first auxiliary flap 240 can engage the second partition slot 322 of the upper insert partition 130 to retain the first auxiliary flap 240 in position relative to the upper insert partition 130. Once in this configuration, the first auxiliary section 242 can be oriented at about 90° relative to the first intermediate panel 216 (shown in FIG. 2), and the second auxiliary section 246 can be oriented at about 90° relative to the first auxiliary section 242.

Figure 6:
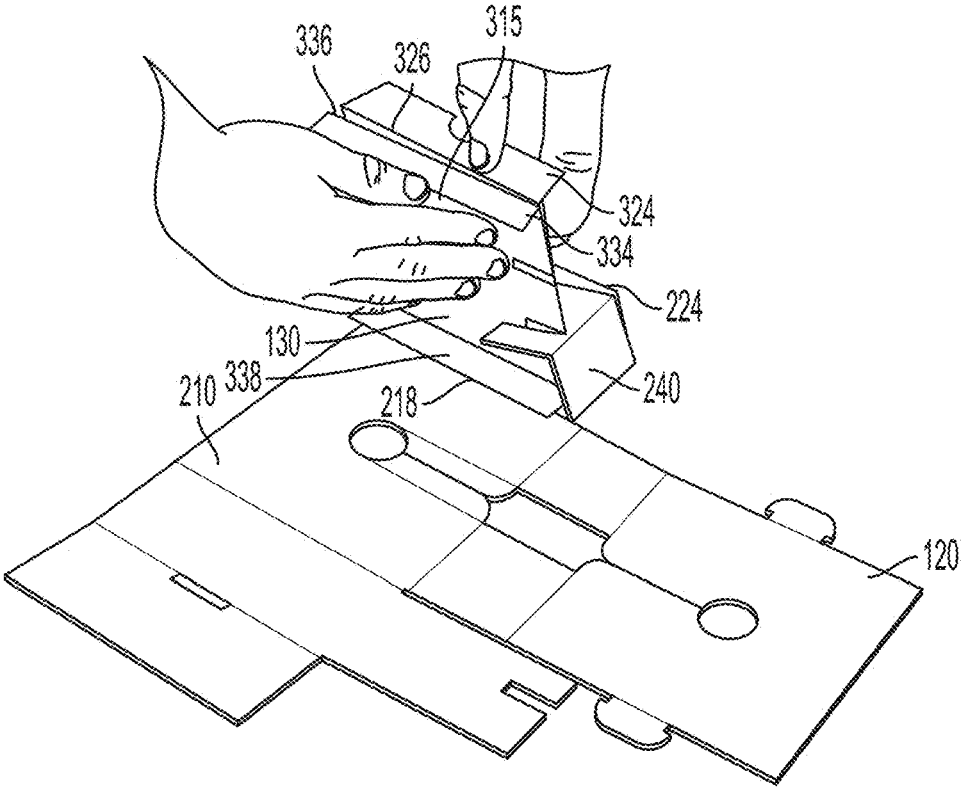
FIG. 6 is a top perspective view of a third step in assembling the upper insert partition of FIG. 3 with the upper insert body of FIG. 2.

Referring to FIG. 6, the first large spacer flap 224 and the first small spacer flap 334 can then be folded away from one another at the first large spacer bend line 326 and the first small spacer bend line 336, respectively, such that the first large and small spacer flaps 224,334 can be oriented about perpendicular with the first and second partition walls 310, 315 (first partition wall 310 shown in FIG. 3) and about parallel with one another. The first outer panel 224 can also be folded at the first outer bend line 226 (shown in FIG. 2) towards the upper insert partition 130, such that the first outer panel 224 can be oriented at about 90° relative to the first intermediate panel 216 (shown in FIG. 2). In a next step, the first intermediate panel 216 can be folded at the first intermediate bend line 218 towards the lower base panel 210, such the first intermediate panel 216 can be oriented at about 90° relative to the lower base panel 210 and the second partition wall 315 of the upper insert partition 130 can face and be substantially parallel with the lower base panel 210. The first small spacer flap 334 and second small spacer flap 338 can extend between the lower base panel 210 and the second partition wall 315, to space the second partition wall 315 from the lower base panel 210 by the height $H_2$ (shown in FIG. 3).

Figure 7:
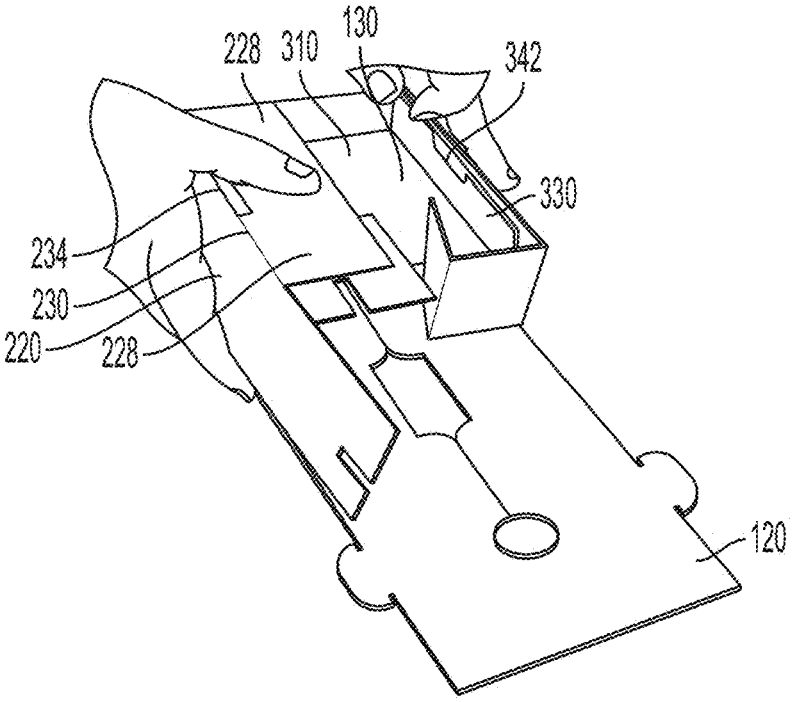
FIG. 7 is a top perspective view of a fourth step in assembling the upper insert partition of FIG. 3 with the upper insert body of FIG. 2.

Referring to FIG. 7, the second intermediate panel 220 can then be folded at the second intermediate bend line 222 (shown in FIG. 2) towards the upper insert partition 130, such the second intermediate panel 220 can be oriented at about 90° relative to the lower base panel 210 (shown in FIG. 2) and can lie substantially flat against the first large spacer flap 224 and first small spacer flap 334. Additionally, the second outer panel 228 can be folded at about 90° relative to the second intermediate panel 220 at the second outer bend line 230. In example aspects, each of the first and second outer panels 224,228 (first outer panel 224 shown in FIG. 2) can be oriented about parallel with the first partition wall 310 of the upper insert partition 130, and can be spaced from the first partition wall 310 by the first and second large spacer flaps 324,330 (first large spacer flap 324 shown in FIG. 3). As such, the first and second outer panels 224,228 can be spaced from the first partition wall 310 by the distance $H_1$ (shown in FIG. 2). According to example aspects, the first locking slot 232 (shown in FIG. 2) and second locking slot 234 can be configured to substantially align with the first locking cut-out 342 and the second locking cut-out 344 (shown in FIG. 3), respectively.

Figure 8:
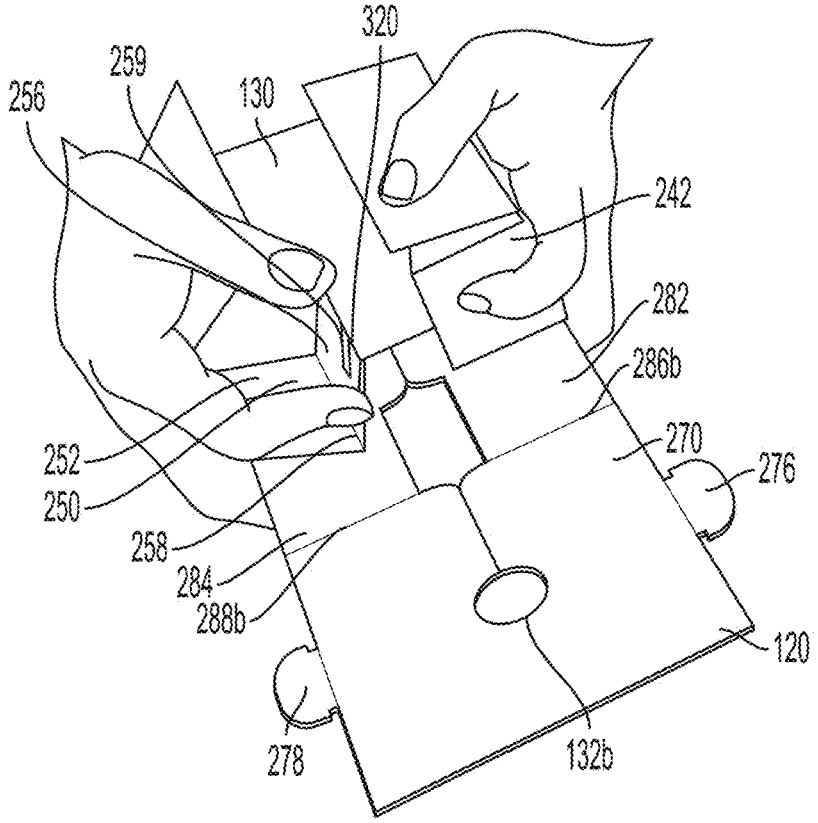
FIG. 8 is a top perspective view of a fifth step in assembling the upper insert partition of FIG. 3 with the upper insert body of FIG. 2.

FIG. 8 illustrates a next step in the method, wherein the second auxiliary flap 250 can be folded towards the upper insert partition 130 at each of the third auxiliary bend line 254 (shown in FIG. 2) and the fourth auxiliary bend line 258. The second auxiliary slot 259 of the second auxiliary flap 250 can engage the first partition slot 320 of the upper insert partition 130 to retain the second auxiliary flap 250 in position relative to the upper insert partition 130. In this configuration, the third auxiliary section 252 can be oriented at about 90° relative to the second intermediate panel 220 (shown in FIG. 2), and the fourth auxiliary section 256 can be oriented at about 90° relative to the third auxiliary section 252. The first connecting panel 282 and second connecting panel 284 can then be folded towards the upper insert partition 130 at the first connecting bend lines 286*a*,288*a* (shown in FIG. 2). The first connecting panel 282 and second connecting panel 284 can abut the first auxiliary section 242 and third auxiliary section 252, respectively, of the upper insert body 120. As such, the first and second connecting panels 282,284 can be oriented at about 90° relative to the lower base panel 210 (shown in FIG. 2). The upper base panel 270 can then be folded relative to the first and second connecting panels 282,284 at the first and second connecting bend lines 286*b*,288*b* towards the upper insert partition 130.

Figure 9:
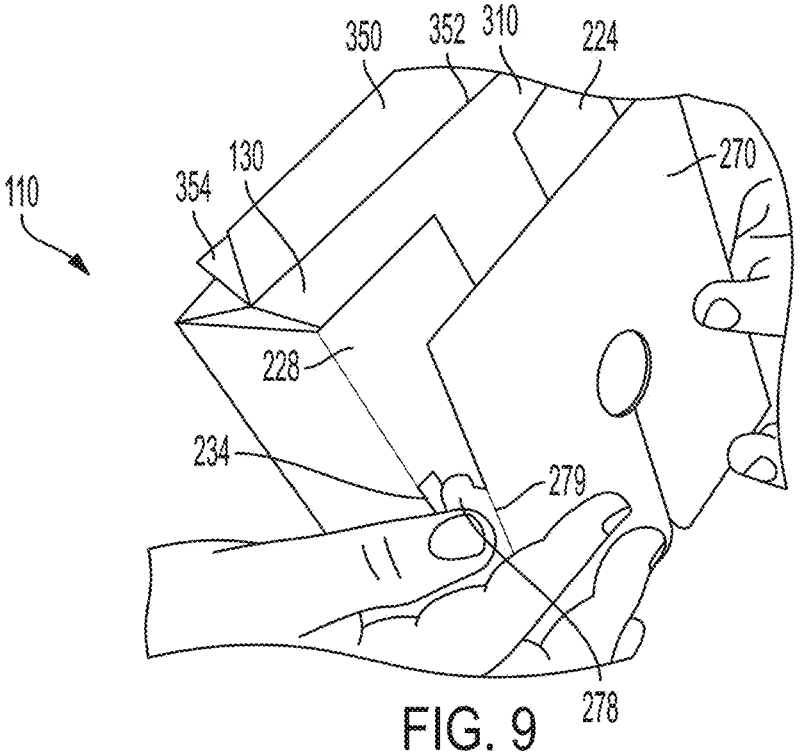
FIG. 9 is a top perspective view of a sixth and final step in assembling the upper insert partition of FIG. 3 with the upper insert body of FIG. 2 to define the upper bottle insert of FIG. 1.

FIG. 9 illustrates folding the upper base panel 270 towards the upper insert partition 130. According to example aspects, before or during folding the upper base panel 270, the first locking tab 276 (shown in FIG. 2) and the second locking tab 278 can be folded relative to the upper base panel 270 at the first tab bend line 277 (shown in FIG. 2) and the second tab bend line 279, respectively. The first and second locking tabs 276,278 can be oriented at about 90° relative to the upper base panel 270 and can be configured to align with the first locking slot 232 (shown in FIG. 2) and the second locking slot 234, respectively. As the upper base panel 270 is folded towards the upper insert partition 130, the first and second locking tabs 276,278 can be inserted through the first and second locking slots 232,234 to retain the upper bottle insert 110 in an assembled configuration. The first and second locking tabs 276,278 can also engage the first and second locking cut-outs 342,344, respectively, in the assembled configuration. In example aspects, the upper base panel 270 can face and can be oriented about parallel with the first partition wall 310 of the upper insert partition 130, as shown. Furthermore, in example aspects, the upper base panel 270 may be configured to lie against the first outer panel 224 and second outer panel 228 of the upper insert body 120. The first end flap 350 and the second end flap 354 can then be folded away from one another at the first end bend line 352 and the second end bend line 356 (shown in FIG. 3), respectively, such that they can be oriented substantially parallel to the corresponding first partition wall 310 and second partition wall 315 (shown in FIG. 3).

In the assembled configuration, the upper base panel 270 can be spaced from the first partition wall 310 by the first and second large spacer flaps 324,330 (shown in FIG. 3) at the height $H_1$, and the lower base panel 210 (shown in FIG. 2) can be spaced from the second partition wall 315 (shown in FIG. 3) by the first and second small spacer flaps 334,338 at the height $H_2$. As described above, the height $H_1$ can be greater than the height $H_2$. As such, in instances wherein a taller one of the bottles 180 (shown in FIG. 1) is being restrained within the bottle packaging 170 by the bottle insert assembly 100 (shown in FIG. 1), the upper bottle insert 110 (shown in FIG. 1) can be oriented such that the upper portion 182 (shown in FIG. 1) of the bottle 180 can extend through the second upper bottle opening 132*b* formed through the upper base panel 270 to abut the first partition wall 310. In instances wherein a shorter one of the bottles 180 is being restrained by the bottle insert assembly 100, the upper bottle insert 110 can be oriented such that the upper portion 182 of the bottle can extend through the first upper bottle opening 132*b* formed through the lower base panel 210 to abut the second partition wall 315. Furthermore, when the upper bottle insert 110 is assembled within the interior cavity 178 (shown in FIG. 1) of the bottle packaging 170, either the upper base panel 270 or the lower base panel 210 can abut a corresponding one of the sidewalls 180 (shown in FIG. 1), depending upon the orientation of the upper bottle insert 110.

Figure 10:
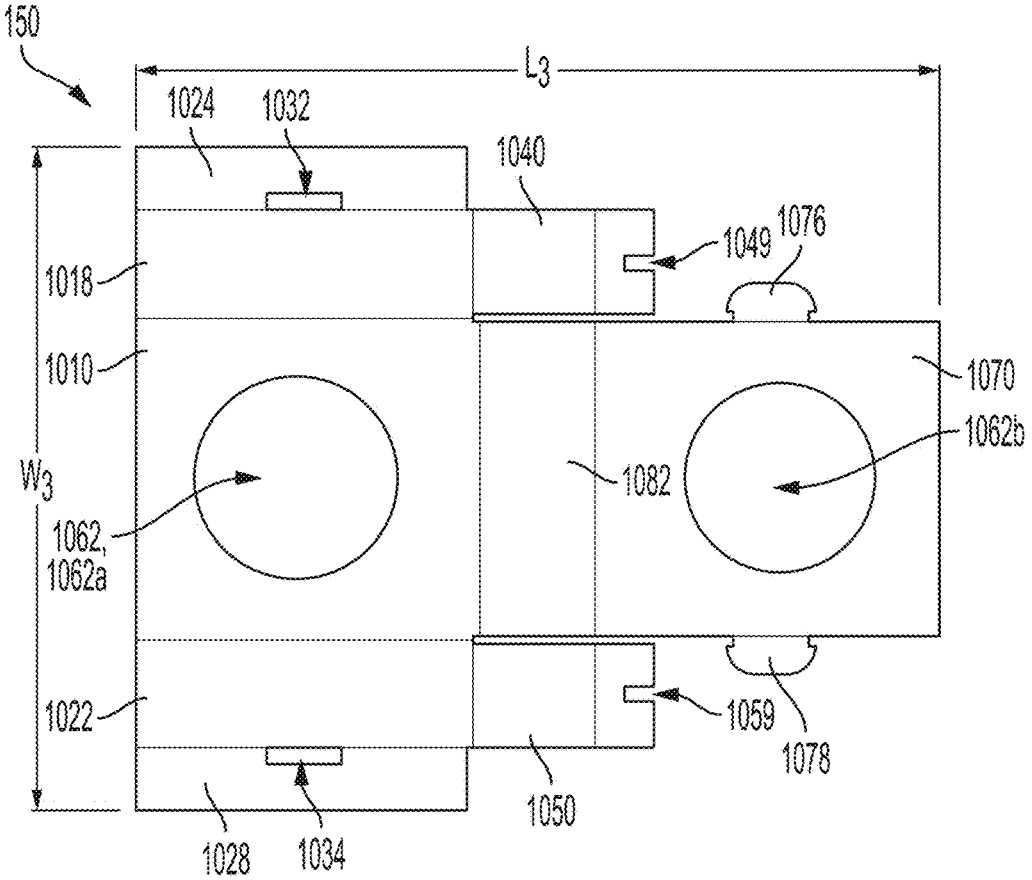
FIG. 10 is a top plan view of a lower insert body of one of the lower insert assemblies of FIG. 1, wherein the lower insert body is in blank form.
Figure 11:
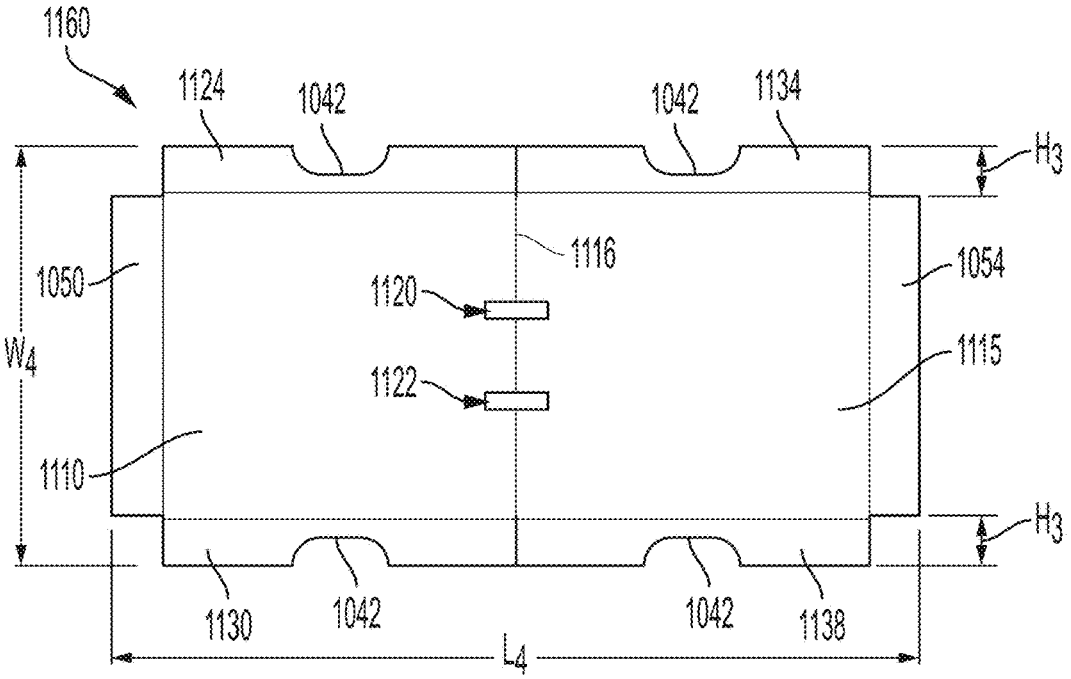
FIG. 11 is a top plan view of a lower insert partition of one of the lower insert assemblies of FIG. 1, wherein the lower insert partition is in blank form.

FIGS. 10 and 11 illustrates the lower insert body 150 and the lower insert partition 1160, respectively, of the lower bottle insert 140 (shown in FIG. 1) in blank form, according to example aspects. The lower insert body 150 and lower insert partition 1160 can be substantially similar to the upper insert body 120 and upper insert partition 130 of the upper bottle insert 110 (110,120,130 shown in FIG. 1), respectively. However, the size, shape, and dimensions of various components of the lower bottle insert 140 can vary and/or the lower bottle insert 140 can comprise more or fewer components than the upper bottle insert 110. Furthermore, the lower insert body 150 and the lower insert partition 1160 can be assembled to define the lower bottle insert 140 by substantially the same method as described above for assembling the upper bottle insert 110 (shown in FIG. 1).

Referring to FIG. 10, as shown, the lower insert body 150 can define an overall width $W_3$ and an overall length $L_3$. In a particular example, aspect, the width $W_3$ can be about 11.125" and the length $L_3$ can be about 13.4375". In other aspects, the lower insert body 150 can define any other suitable dimensions. The lower insert body 150 can comprise a lower base panel 1010 and an upper base panel 1070. The lower insert body 150 can further comprise first and second intermediate panels 1018,1022, first and second outer panels 1024,1028, and first and second auxiliary flaps 1040,1050. The first and second outer panels 1024, 1028 can define first and second locking slots 1032, 1034, respectively, and the first and second auxiliary flaps 1040,1050 can define first and second auxiliary slots 1049,1059, respectively. Additionally, first and second locking tabs 1076, 1078 can extend from the upper base panel 1070. However, unlike the upper insert body 120, the lower insert body 150 does not comprise two connecting panels extending between the lower and upper base panels 1010,1070 with a gap formed therebetween; rather, the lower insert body 150 can comprise a singular connecting panel 1082 connecting the lower base panel 1010 to the upper base panel 1070. Furthermore, as shown, the lower base panel 1010 can define a first one of the lower bottle openings 1062*a*, and the upper base panel 1070 can define a second one of the lower bottle openings 1062*b*. However, unlike the upper insert body 120, the lower and upper base panels 1010,1070 do not define the bottle channels nor the channel tabs. The lower portion 1284 (shown in FIG. 12) of a corresponding one of the bottles 180 (shown in FIG. 1) can engage either of the first and second lower bottle openings 1062*a,b* by inserting the lower portion 1284 directly through the first or second lower bottle opening 1062*a,b*.

Referring to FIG. 11, as shown, the lower insert partition 1160 can define an overall width $W_4$ and an overall length $L_4$. In a particular example, aspect, the width $W_4$ can be about 6.5625" and the length $L^4$ can be about 12.675". In other aspects, the lower insert partition 1160 can define any other suitable dimensions. As shown, the lower insert partition 1160 can comprise a first partition wall 1110 and a second partition wall 1115 hingedly connected to the first partition wall 1110 by a partition wall bend line 1116. A first partition slot 1120 and a second partition slot 1122 can extend across the partition wall bend line 1116. Opposing first and second spacer flaps 1124,1130 can extend from the first partition wall 1110, and opposing first and second spacer flaps 1134, 1138 can extend from the second partition wall 1115. Each of the spacer flaps 1124, 1130, 1134, 1138 can define a height $H_3$. In other aspects, the heights of the spacer flaps 1124,1130, 1134,1138 may vary. Furthermore, each of the spacer flaps 1124, 1130,1134, 1138 can define a locking cut-out 1042, as shown. A first end flap 1050 can extend from the first partition wall 1110, and a second end flap 1054 can extend from the second partition wall 1115.

As noted above, the lower insert body 150 and the lower insert partition 1160 can be assembled to define the lower bottle insert 140 by substantially the same method as described above for assembling the upper bottle insert 110 (shown in FIG. 1). For example, the first partition wall 1110 can be folded towards the second partition wall 1115 at the partition wall bend line 1116. The spacer flaps 1130, 1138 can be folded away from one another, such that the spacer flap 1130 and spacer flap 1138 can be oriented about perpendicular to the first partition wall 1110 and second partition wall 1115 and about parallel with one another. The spacer flaps 1130,1138 can engage and lie substantially flat against the first intermediate panel 1018. The first auxiliary flap 1040 can be folded towards the lower insert partition 1160. The first auxiliary slot 1049 of the first auxiliary flap 1040 can engage the second partition slot 1122 to retain the first auxiliary flap 1040 in position relative to the lower insert partition 1160.

The spacer flaps 1124, 1134 can then be folded away from one another, such that the spacer flaps 1124, 1134 can be oriented about perpendicular with the first and second partition walls 1110, 1115 and about parallel with one another. The first outer panel 1024 can also be folded towards the lower insert partition 1160, such that the first outer panel 1024 can be oriented at about 90° relative to the first intermediate panel 1018. In a next step, the first intermediate panel 1018 can be folded towards the lower base panel 1010. The spacer flaps 1134, 1138 can extend between the lower base panel 1010 and the second partition wall 1115, to space the second partition wall 1115 from the lower base panel 1010 by the height $H_3$. The second intermediate panel 1022 can then be folded towards the lower insert partition 1160, such the second intermediate panel 1022 can lie substantially flat against the spacer flaps 1124, 1134. Additionally, the second outer panel 1028 can be folded at about 90° relative to the second intermediate panel 1022. In example aspects, each of the first and second outer panels 1024,1028 can be oriented about parallel with the first partition wall 1110, and can be spaced from the first partition wall 1110 by the height $H_3$. According to example aspects, the first locking slot 1032 and second locking slot 1034 can be configured to substantially align with a corresponding one of the locking cut-outs 1042.

Figure 12:
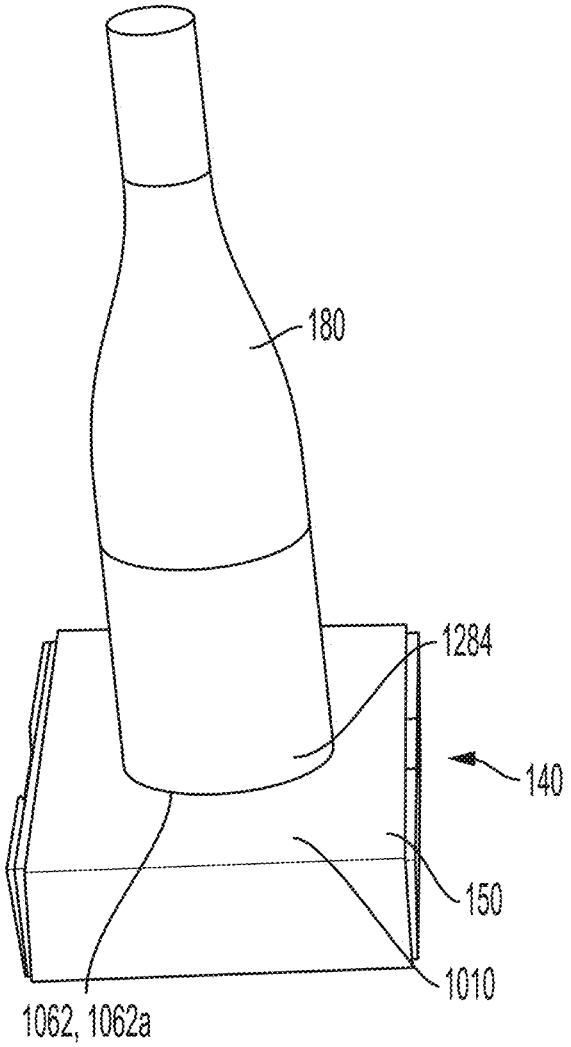
FIG. 12 is a top perspective view of a bottle engaged with an assembled one of the lower insert assemblies of FIG. 1.

The second auxiliary flap 1050 can be folded towards the lower insert partition 1160, and the second auxiliary slot 1059 can engage the first partition slot 1120 to retain the second auxiliary flap 1050 in position relative to the lower insert partition 1160. The connecting panel 1082 can then be folded towards the lower insert partition 1160 and can be oriented at about 90° relative to the lower base panel 1010. The upper base panel 1070 can then be folded relative to the connecting panels 1082 towards the lower insert partition 1160. The first and second locking tabs 1076, 1078 can be folded relative to the upper base panel 1070 and can be configured to align with the first and second locking slot 1032,1034, respectively. As the upper base panel 1070 is folded towards the lower insert partition 1160, the first and second locking tabs 1076, 1078 can be inserted through the first and second locking slots 1032, 1034 to retain the lower bottle insert 150 in an assembled configuration. The first and second locking tabs 1076, 1078 can also engage the corresponding locking cut-outs 1042 in the assembled configuration. In example aspects, the upper base panel 1070 can face and can be oriented about parallel with the first partition wall 1110 and can be configured to lie against the first and second outer panels 1024,1028. In the assembled configuration, the upper base panel 1070 can be spaced from the first partition wall 1110 by the spacer flaps 1124, 1130 at the height $H_3$. The first end flap 1050 and the second end flap 1054 can then be folded away from one another, such that they can be oriented substantially parallel to the corresponding first partition wall 1110 and second partition wall 1115. FIG. 12 illustrates the assembled lower bottle insert 140 with the lower portion 1284 of a corresponding one of the bottles 180 received through one of the lower bottle openings 1062. For example, in the present aspect, the lower portion 1284 of the bottle 180 can extend through the extend through the first lower bottle opening 1062*a* formed through the lower base panel 1010 to abut the section partition wall 1115 (shown in FIG. 11). In other aspects, the lower portion 1284 of the bottle 180 can extend through the second lower bottle opening 1062*b* (shown in FIG. 10) formed through the upper base panel 1070 (shown in FIG. 10) to abut the first partition wall 1110 (shown in FIG. 11). Moreover, when the lower bottle insert 140 is assembled within the interior cavity 178 (shown in FIG. 1) of the bottle packaging 170 (shown in FIG. 1), either the upper base panel 1170 or the lower base panel 1110 can abut a corresponding one of the sidewalls 180 (shown in FIG. 1), depending upon the orientation of the lower bottle insert 140.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A bottle packaging assembly comprising:

a bottle packaging comprising a sidewall enclosure, the sidewall enclosure defining an interior cavity and comprising a first sidewall and a second sidewall opposite the first sidewall;

a plurality of bottle insert assemblies arranged laterally side-by-side within the interior cavity, wherein each of the bottle insert assemblies comprises:

a first bottle insert arranged proximate to the first sidewall and defining a first bottle opening configured to receive a first portion of a bottle; and a second bottle insert arranged proximate to the second sidewall and longitudinally aligned with the first bottle insert, the second bottle insert defining a second bottle opening configured to receive a second portion of the bottle;

wherein:

the first bottle insert comprises a first insert body and a first insert partition disposed substantially within the first insert body;

the first insert body defines the first bottle opening;

the first insert partition is configured to confront a first end of the bottle;

the second bottle insert comprises a second insert body and a second insert partition disposed substantially within the second insert body;

the second insert body defines the second bottle opening;

the second insert partition is configured to confront a second end of the bottle;

the first insert body comprises a first base panel defining the first bottle opening;

the first insert partition comprises a first partition wall spaced from and substantially parallel to the first base panel;

the second insert body comprises a second base panel defining the second bottle opening; and the second insert partition comprises a second partition wall spaced from and substantially parallel to the first base panel.

2. The bottle packaging assembly of claim 1, wherein the first base panel defines a bottle channel extending from the first bottle opening to a panel edge of the first base panel, the bottle channel allowing the first portion of the bottle to pass therethrough.

3. The bottle packaging assembly of claim 2, wherein the first bottle insert further comprises a first channel tab and a second channel tab hingedly connected to the first base panel, the first channel tab and the second channel tab extending towards one another and substantially covering the bottle channel.

4. The bottle packaging assembly of claim 1, wherein a first spacer flap extends between the first partition wall and the first base panel to maintain a distance between the first partition wall and the first base panel, the first spacer flap arranged perpendicular to the first partition wall and the first base panel.

5. The bottle packaging assembly of claim 4, wherein:

the first insert partition defines the first spacer flap;

the first spacer flap is hingedly coupled to the first partition wall;

the first insert body comprises a first intermediate panel hingedly connected to the first base panel; and the first spacer flap lies substantially flat against the first intermediate panel.

6. The bottle packaging assembly of claim 1, wherein:

each of the first bottle inserts defines a first intermediate panel configured to confront the first intermediate panel of an adjacent one of the first bottle inserts; and each of the second bottle inserts defines a second intermediate panel configured to confront the second intermediate panel of an adjacent one of the second bottle inserts.

7. The bottle packaging assembly of claim 6, wherein:

each of the first base panel and the second base panel is an inner base panel;

each of the first bottle insert and the second bottle insert comprises an outer base panel;

the first intermediate panel extends between the inner base panel and the outer base panel of the first bottle insert;

the second intermediate panel extends between the inner base panel and the outer base panel of the second bottle insert;

the first partition wall is arranged between and is substantially parallel to each of the inner base panel and the outer base panel of the first bottle insert; and the second partition wall is arranged between and is substantially parallel to each of the inner base panel and the outer base panel of the second bottle insert.

8. A bottle packaging assembly comprising:

a bottle packaging comprising a sidewall enclosure, the sidewall enclosure defining an interior cavity and comprising a first sidewall and a second sidewall opposite the first sidewall;

a plurality of bottle insert assemblies arranged laterally side-by-side within the interior cavity, wherein each of the bottle insert assemblies comprises:

a first bottle insert arranged proximate to the first sidewall and defining a first bottle opening configured to receive a first portion of a bottle; and a second bottle insert arranged proximate to the second sidewall and longitudinally aligned with the first bottle insert, the second bottle insert defining a second bottle opening configured to receive a second portion of the bottle;

wherein:

the first bottle insert comprises a first insert body;

the first insert body comprises a first base panel defining the first bottle opening;

the first base panel defines a bottle channel extending from the first bottle opening to a panel edge of the first base panel; and the bottle channel allows the first portion of the bottle to pass therethrough.

9. The bottle packaging of claim 8, wherein the first bottle insert further comprises a first channel tab connected to the first base panel and at least partially covering the bottle channel.

10. The bottle packaging of claim 9, wherein the first bottle insert further comprises a second channel tab hingedly connected to the first base panel, and wherein the first channel tab and the second channel tab extend towards one another and substantially cover the bottle channel.

11. A bottle packaging assembly comprising:

a bottle packaging comprising a sidewall enclosure, the sidewall enclosure defining an interior cavity and comprising a first sidewall and a second sidewall opposite the first sidewall;

a plurality of bottle insert assemblies arranged laterally side-by-side within the interior cavity, wherein each of the bottle insert assemblies comprises:

a first bottle insert arranged proximate to the first sidewall and defining a first bottle opening configured to receive a first portion of a bottle; and a second bottle insert arranged proximate to the second sidewall and longitudinally aligned with the first bottle insert, the second bottle insert defining a second bottle opening configured to receive a second portion of the bottle;

wherein:

the first bottle insert comprises a first insert body and a first insert partition disposed substantially within the first insert body;

the first insert body comprises a first base panel defining the first bottle opening;

the first insert partition comprises a first partition wall spaced from and substantially parallel to the first base panel; and a first spacer flap extends between the first partition wall and the first base panel to maintain a distance between the first partition wall and the first base panel.

12. The bottle packaging of claim 11, wherein the first spacer flap is arranged perpendicular to the first partition wall and the first base panel.

13. The bottle packaging of claim 12, wherein:

the first insert partition defines the first spacer flap;

the first spacer flap is hingedly coupled to the first partition wall;

the first insert body comprises a first intermediate panel hingedly connected to the first base panel; and the first spacer flap lies substantially flat against the first intermediate panel.

14. A bottle packaging assembly comprising:

a bottle packaging comprising a sidewall enclosure, the sidewall enclosure defining an interior cavity and comprising a first sidewall and a second sidewall opposite the first sidewall;

a plurality of bottle insert assemblies arranged laterally side-by-side within the interior cavity, wherein each of the bottle insert assemblies comprises:

a first bottle insert arranged proximate to the first sidewall and defining a first bottle opening configured to receive a first portion of a bottle; and a second bottle insert arranged proximate to the second sidewall and longitudinally aligned with the first bottle insert, the second bottle insert defining a second bottle opening configured to receive a second portion of the bottle;

wherein:

the first bottle insert comprises an inner base panel, an outer base panel, and a first connecting panel extending between the inner base panel and the outer base panel;

the first connecting panel is perpendicular to the inner base panel; and the outer base panel is perpendicular to the first connecting panel and parallel to the inner base panel.

15. The bottle packaging of claim 14, wherein:

the first bottle insert further comprise an intermediate panel assembly extending between the inner base panel and the outer base panel;

the intermediate panel assembly defines a locking slot; and the first bottle insert further comprises a locking tab engaged with the locking slot to retain the first bottle insert in an assembled configuration.

* * * * *